US005935020A

United States Patent [19]

Stites et al.

[11] Patent Number: 5,935,020

[45] Date of Patent: Aug. 10, 1999

[54] GOLF CLUB HEAD

[75] Inventors: John T. Stites, Fort Worth; Michael G. Taylor, Granbury, both of Tex.

[73] Assignee: Tom Stites & Associates, Inc., Fort Worth, Tex.

[21] Appl. No.: 09/154,252

[22] Filed: Sep. 16, 1998

[51] Int. Cl.[6] ..... A63B 53/04

[52] U.S. Cl. ..... 473/345; 473/291; 473/349

[58] Field of Search ..... 473/324, 345, 473/349, 290, 291, 292

[56] References Cited

U.S. PATENT DOCUMENTS

| | | | |
|---|---|---|---|
| 3,951,413 | 4/1976 | Bilyeu . | |
| 4,021,047 | 5/1977 | Mader . | |
| 4,076,254 | 2/1978 | Nygren . | |
| 4,432,549 | 2/1984 | Zebelean . | |
| 4,444,392 | 4/1984 | Duclos . | |
| 4,461,481 | 7/1984 | Kim . | |
| 4,697,813 | 10/1987 | Inoue . | |
| 5,013,041 | 5/1991 | Sun et al. . | |
| 5,050,879 | 9/1991 | Sun et al. . | |
| 5,273,283 | 12/1993 | Bowland . | |
| 5,310,186 | 5/1994 | Karsten . | |
| 5,346,217 | 9/1994 | Tsuchiya et al. | 473/345 |
| 5,366,223 | 11/1994 | Werner et al. . | |
| 5,398,935 | 3/1995 | Katayama | 473/349 X |
| 5,482,280 | 1/1996 | Yamawaki | 473/290 |
| 5,518,240 | 5/1996 | Igarashi . | |
| 5,573,467 | 11/1996 | Chou et al. | 473/289 |
| 5,647,808 | 7/1997 | Hosokawa . | |

*Primary Examiner*—Klen T. Nguyen

*Attorney, Agent, or Firm*—Randall C. Brown; Rick Matos; Akin, Gump, Strauss, Hauer & Feld, L.L.P.

[57] ABSTRACT

A driver type, hollow-bodied golf club head in which multiple parameters are controlled to be within defined ranges of values to enhance the performance and playability of the club. The parameters which are controlled include the club head's maximum dimensions, the position of the center-of-gravity, the size of striking face, and the position of the shaft attachment point.

21 Claims, 3 Drawing Sheets

GOLF CLUB HEAD

FIELD OF THE INVENTION

The present invention relates generally to a driver-type golf club head. More particularly, the present invention relates to a driver-type golf club head which is designed to enhance the performance and playability of a golf club to which the head is attached.

BACKGROUND OF THE INVENTION

A number of factors influence the trajectory of a golf ball which has been struck by a golf club. These factors include, for example, the golfer's stance, the golfer's swing and the design of the golf club. Many golfers spend a considerable amount of time and money to develop a stance and swing that will allow the golfer to strike a golf ball effectively to project a ball along an optimum trajectory. Despite these efforts, many golfers have difficulty mastering control over their swing and the ball trajectory and consequently seek to improve their game by selecting golf clubs which are designed to provide superior performance and playability. As used herein, the terms "performance" and "playability" refer to the ease with which a golf club can be used to produce consistently satisfactory results.

Golf clubs are generally divided into three main categories: putters, irons, and woods. The golf clubs in the woods category include the driver, which is also known as the number one wood, and the fairway woods, which typically include the number three, four, five, and seven woods. Most of the club heads in the woods category are currently fashioned from metals such as titanium, and such heads commonly have a hollow, thin-walled design. The performance and playability of a driver is particularly important, because the driver is customarily used in making the longest shot a golfer takes when playing a given hole. Thus, an error made when striking a golf ball with a driver will have particularly adverse affect on the trajectory of the golf ball.

It is known in the art that certain parameters relating to the design of a driver head will influence the performance and playability of the driver. For example, placing most of the weight of a head about its exterior edges will increase the mass moment of inertia of the head, and the head will consequently tend to provide a straighter ball trajectory even when the ball strikes the club face at a less than optimal point.

Another parameter which influences the playability of a driver is the position of the center-of-gravity of the head. U.S. Pat. No. 5,050,879 to Sun and U.S. Pat. No. 5,013,041 to Sun disclose driver heads having cavities which are adapted to receive various sized weights so as to adjust the center-of-gravity of the head and customize the driver head to best suit a particular golfer. U.S. Pat. No. 4,461,481 to Sunyong, and U.S. Pat. No. 3,951,413 to Bilyeus disclose drivers with heads having a center-of-gravity that is repositioned while the club is swinging. The heads disclosed in these patents achieve this effect by the placement of moveable weights within the head. U.S. Pat. No. 4,432,549 to Zebelan discloses a driver head which controls the position of the center-of-gravity by varying the wall thicknesses of the various sides of the head.

Other parameters which can influence the playability of a driver include the aerodynamic characteristics of the head, as disclosed in U.S. Pat. No. 4,444,392 to Duclos, and the angular orientation of the club face which is used to strike a golf ball. In U.S. Pat. No. 5,366,223 to Werner, a driver head is disclosed that has a face which is tilted upward at an angle of 20 degrees or more at the toe to cause a better correlation between a typical golfer's hit pattern and the perimeter of the club face. It is also known that by maximizing the dynamic face angle of a driver head, an average golfer will be better able to close the face angle at the moment of impact of the driver head and the golf ball. The dynamic face angle is measured between the line extending from the hosel (i.e., the point at which the shaft is attached to the head) to the center of gravity of the head, and the line which is tangent to the outermost point of the front surface of the head. The face angle is measured between the line along which the head is moving at the moment of impact with a golf ball and the horizontal axis of the elliptical front surface the head, and is "closed" when the line of movement is substantially normal to the horizontal axis.

From the foregoing, it will be understood that a variety of parameters relating to the design of a driver head can impact the performance and playability of the club on which it is used. It will also be understood that a need exists for a driver head in which multiple parameters are defined in a specific way, such that their combined effect is to produce a driver having greatly enhanced performance and playability.

SUMMARY OF THE INVENTION

The present invention comprises a driver-type golf club head in which multiple parameters defining the geometry and weight characteristics of the club head are specified to be within certain measurable ranges. The combined effect of defining the geometry and weight characteristics of the club head of the present invention is to produce a driver-type golf club head having greatly enhanced performance and playability. The driver-type golf club head of the present invention achieves this result with a geometry that conforms to the specifications of United States Golf Association (USGA) rules governing golf club designs.

According to a preferred embodiment of the present invention, the driver-type golf club comprises a metallic club head having a defined volume and comprising:

- a heel having adjacent thereto a surface defining a bore for receiving one end of an elongated shaft, the center of said bore being spaced a radial distance (BP) from an outermost position on said heel;
- a substantially vertical and substantially planar striking face having a defined face length (FL) as measured in a longitudinal direction and a defined face height (FH) as measured in a vertical direction;
- a substantially horizontal crown defined by a proximate crown portion connected to said face, a distal crown portion opposing said proximate crown portion, and first and second opposing crown intermediate portions each interposed and connected to each of said proximate and distal crown portions, said first and said second opposing crown intermediate portions being spaced by a defined head length (HL) as measured in the longitudinal direction, and said proximate and said distal crown portions being spaced by a head breadth (BR) as measured in a lateral direction;
- a substantially horizontal sole opposing said crown, and having a lowermost portion spaced from an uppermost position on said crown by a head height (CH) as measured in the vertical direction, said sole having a proximate sole portion connected to said face, a distal sole portion opposing said proximate portion, and first and second opposing sole intermediate portions each interposed and connected to each of said proximate and distal sole portions; and a peripheral surface interposed said crown and said sole, connected to each of said distal and intermediate crown portions, each of said distal and intermediate sole portions and to said face; wherein:

said club head has a center of gravity (CG) spaced a vertical distance (CGz) from said lowermost portion of said sole, spaced a longitudinal distance (CGy) from said outermost position on said heel, and spaced a lateral distance (CGx) from said front surface;

said club head length (HL) is greater than about 4.25 inches and less than about 4.50 inches;

said club head breadth (BR) is greater than about 4.15 inches and less than about 4.45 inches; and the difference (HL−BR) between said club head length (HL) and said club head breadth (BR) is less than about 0.25 inches and greater than about 0 inches.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein.

DETAILED DESCRIPTION OF THE INVENTION

Figure 1:
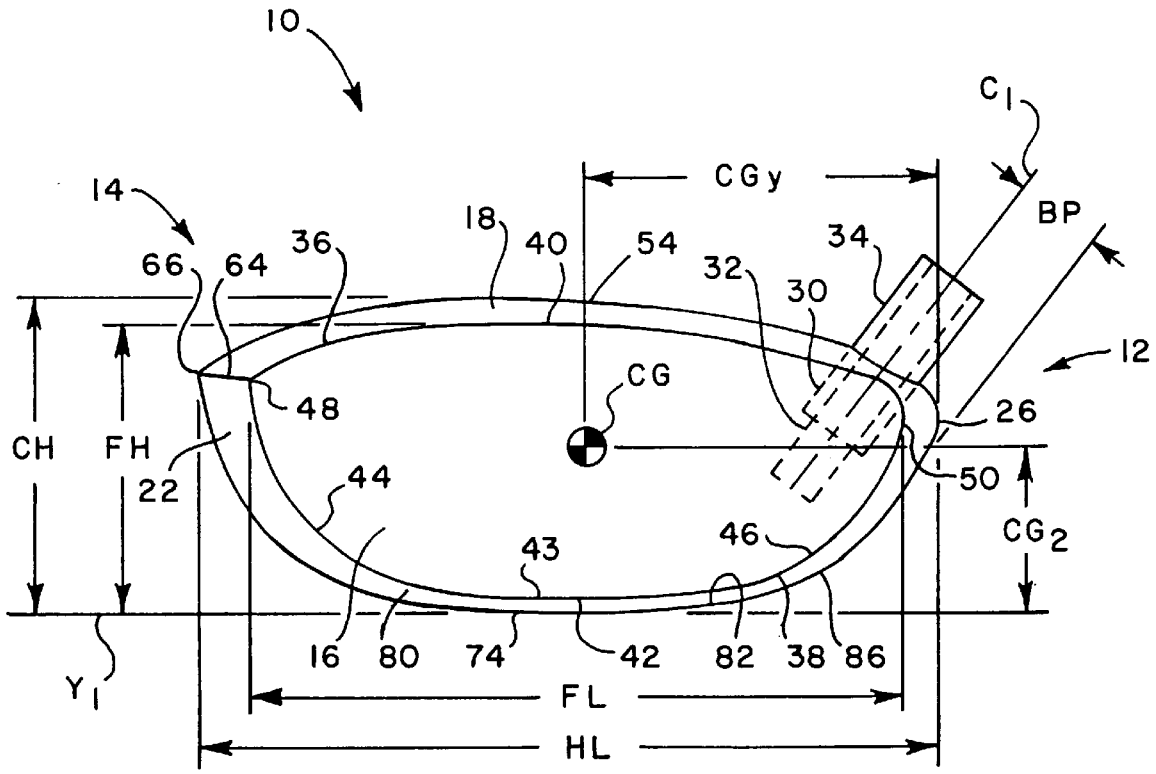
FIG. 1 is a side elevation of a preferred embodiment of a driver-type, hollow body golf club head according to the present invention.
Figure 2:
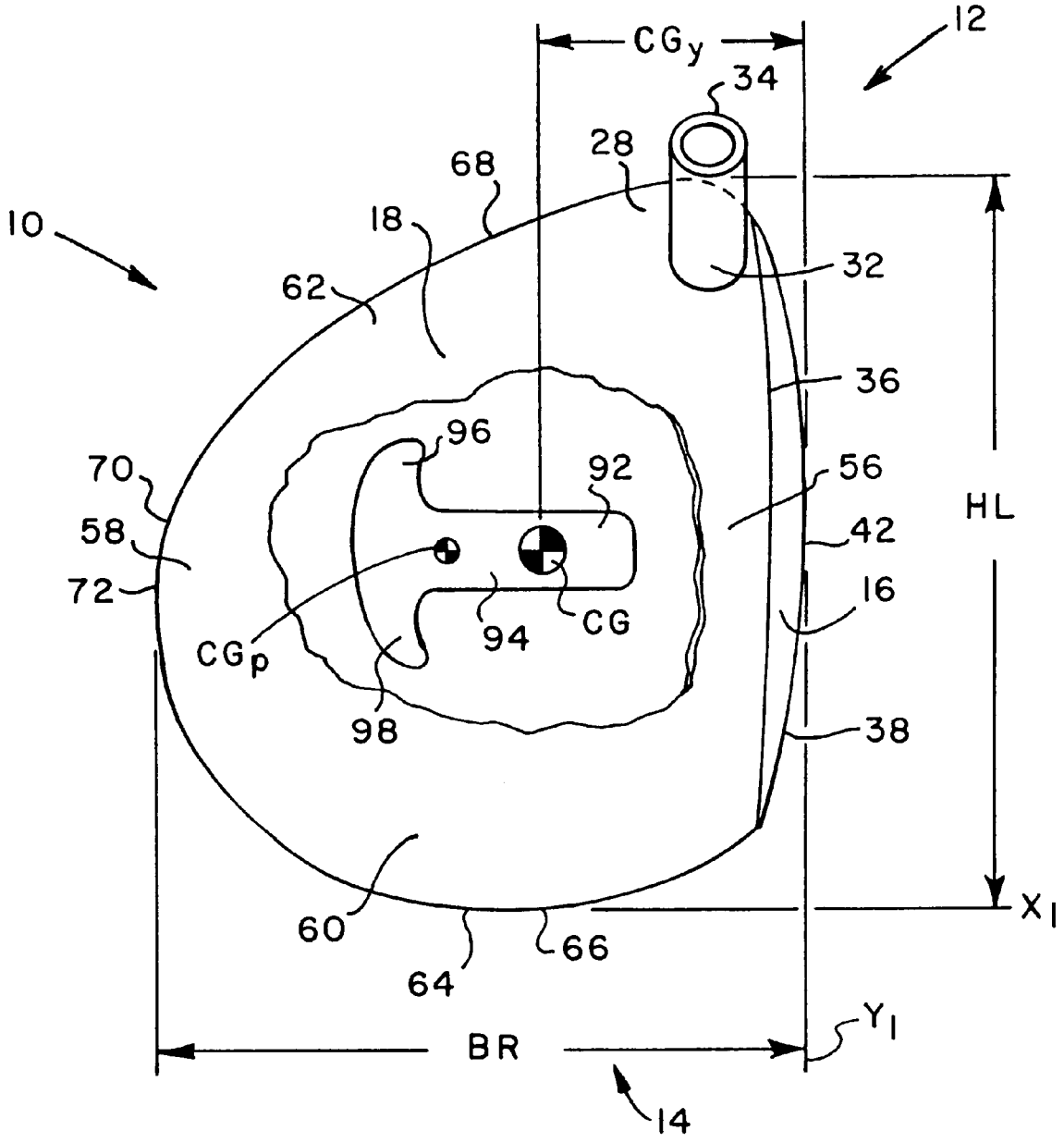
FIG. 2 is a top elevation of the driver-type, hollow body golf club head according to the present invention as shown in FIG. 1.
Figure 3:
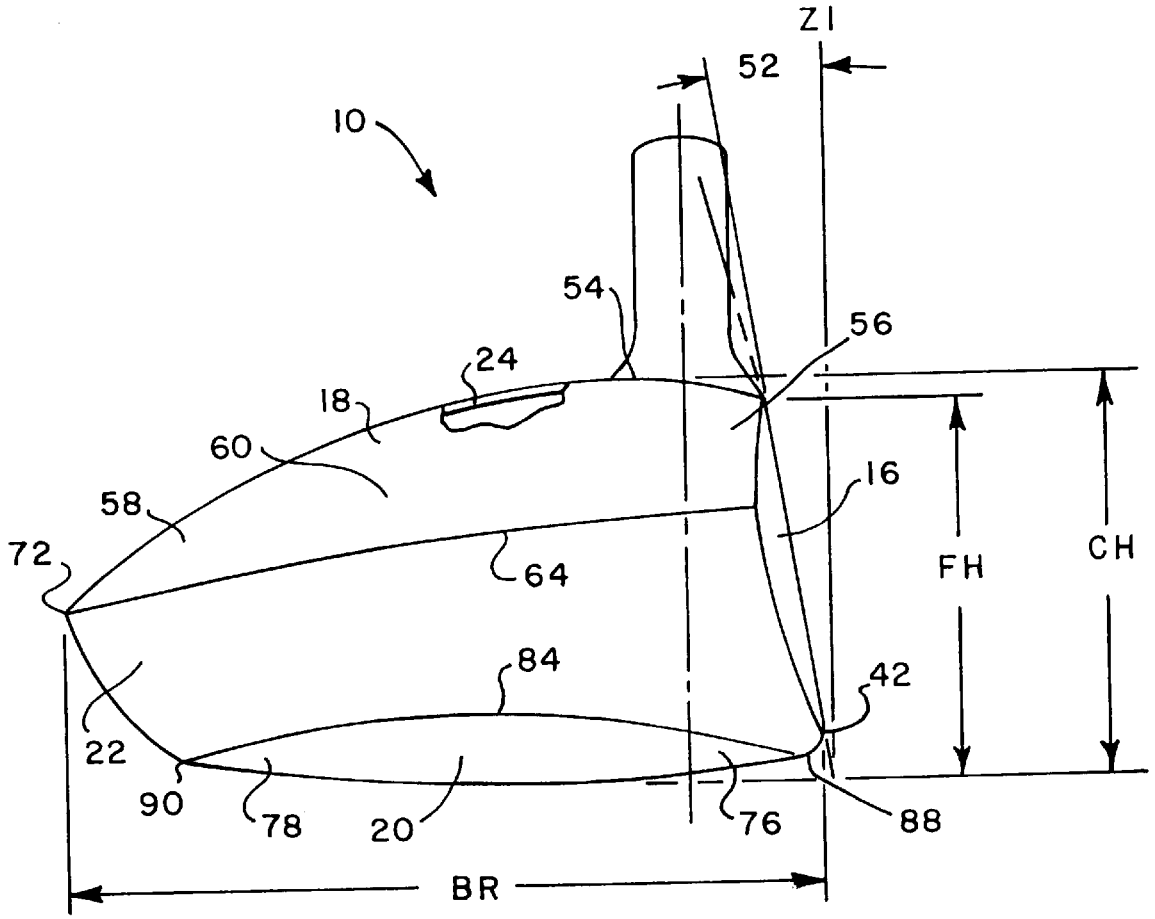
FIG. 3 is a front elevation of the driver-type hollow body golf club head according to the present invention as shown in FIG. 1.

Referring now to FIGS. 1–3, in which like reference numerals are used throughout for like parts, a preferred embodiment of the driver-type golf club head according to the present invention is depicted. In order to clarify subsequently described measurements of certain parameters relating to the geometry and weight distribution of the head, such measurements are defined in x (lateral or breadth), y (longitudinal or length), and z (vertical or height) directions.

The head (10) includes a heel (12), a toe (14), a striking face (16), a crown (18), a sole (20), and a peripheral belt or surface (22), and preferably comprises one or more ceramic, metallic and/or polymeric materials known to those of ordinary skill in the art, such as, for example, titanium, stainless steel, aluminum and plastic. In a preferred embodiment of the present invention, the head comprises titanium and has a hollow, unitary construction with a wall thickness (24).

The heel (12) includes a heel point (26), which is at the outermost position of the head (10) at the heel (12) in the longitudinal direction. A bore surface (28) is positioned adjacent to the heel and defines a circular bore or hosel (30) which depends angularly downward into the head (10). The diameter of the circular bore (30) is selected to accommodate an end (32) of an elongated shaft (34), a portion of which is shown and which extends upwards to a grip (not shown) which is grasped by a golfer when swinging a club to which the head (10) is attached. Those of ordinary skill in the art will recognize that the elongated shaft (34) can be secured to the head (10) by a number of conventional means, such as, for example, adhesives, threaded connections, snap connections, locking connections, interference or pressure fits, and combinations thereof. The bore (30) is positioned within the head (10) a desired distance BP from the heel, as measured radially from centerline C1 to heel point (26).

The face (16) is substantially planar and is adapted for striking a golf ball (not shown). The face (16) is preferably slightly convex for performance or manufacturing purposes or both. The term "substantially planar" will be used herein to describe a club head face which exhibits this characteristic. The face (16) also includes an upper edge (36) and a lower edge (38). As best seen in FIG. 1, the upper edge (36) includes a point (40) that is located at the uppermost or highest position of the face (16). The upper edge (36) curves downward on either side of point (40). Also, the uppermost point (40) is spaced from the axis Y1 to define a face height "FH" therebetween as measured in the vertical direction. As best seen in FIG. 2, the Y1 axis is substantially parallel to the planar surface of face (16), and extending in the direction from the heel (12) to the toe (14).

The lower edge (38) includes a point (42) that is located on a substantially linear portion (43) of the lower edge (38) which is at the forwardmost position of the face (16). As best seen in FIGS. 1 and 2, the linear portion (43) is parallel with longitudinal axis Y1. The lower edge (38) curves upward on either side of linear portion (43) and is joined to peripheral surface (22) at corners (44) and (46). The opposite ends of the upper edge (36) and lower edge (38) meet at a face toe point (48) and a face heel point (50), thereby defining a face length "FL" therebetween as measured in the longitudinal direction.

The face (16) is positioned substantially vertically, and it will be understood by those of ordinary skill in the art that the term "substantially vertical" as used to describe the orientation of the face (16) includes orientations in which the face (16) is positioned at a loft angle (52) with respect to axis Z1. The Z1 axis is substantially perpendicular to the Y1 axis, and extends vertically in the direction between the lower edge (38) axis and the crown (18). The loft angle (52) is the acute angle of incidence between a plane defining the face (16) and the vertical axis Z1. The loft angle (52) can be determined by one having ordinary skill in the art based upon desired performance characteristics.

The crown (18) is positioned substantially horizontally and has a generally convex shape which includes a crown point (54) located at the uppermost position of the crown (18). The crown (18) includes a front area or proximate portion (56), a rear area or distal portion (58), a first intermediate portion or crown toe area, and a second intermediate portion or crown heel area (62). It will be understood by those of ordinary skill in the art that the proximate crown portion (56), the distal crown portion (58), the first intermediate crown portion (60) and the second intermediate crown portion (62) are preferably integrally formed to provide a crown (18) that is a single and substantially continuous piece.

The first intermediate crown portion (60) is positioned adjacent and is connected to the peripheral surface (22) along the edge (64), and includes a toe point (66) that is located at the outermost position of the head on first intermediate crown portion (60). The second intermediate crown portion (62) includes the heel point (26) and is positioned adjacent to and is connected to the peripheral surface (22) along the edge (68). The toe point (66) is spaced from the heel point (26) by a head length "HL" as measured in the longitudinal direction to define the spacing between the first and second intermediate crown portions (60) and (62), respectively.

The proximate crown portion (56) curves downward towards and is connected to the intermediate crown portions (60) and (62). The proximate crown portion (56) is also connected to the upper edge (36) of the face (16). The distal crown portion (58) curves downward towards and is connected to the intermediate portions (60) and (62). The distal crown portion (58) is also connected to the peripheral surface (22) at edge (70). A point (72) is located at the rearmost position of the distal crown portion or crown rear area (58). The point (72) is spaced from the forwardmost point (42) on the lower edge (38) of the face (16) by a head breadth BR as measured in the lateral direction. As best seen in FIG. 2, the X1 axis is substantially perpendicular to both the Y1 and Z1 axies and extends in the lateral direction between the face (16) and rear crown area (58).

The sole (20) is preferably a generally convex shape, at least a portion (74) of which is substantially planar. The sole portion (74) is located at the lowermost position on the head (10) and is substantially coplanar with the plane formed by the longitudinal axis Y1 and the lateral axis X1. The portion (74) is spaced from the uppermost point (54) on the crown (18) by a crown height "CH" as measured in the vertical direction to define the overall height of the head (10). The sole (20) includes a front area or proximate portion (76), a rear area or distal sole portion (78), a sole toe area or first intermediate portion (80), and a sole heel area or second intermediate portion (82). It will be understood by those of ordinary skill in the art that the proximate sole portion (76), the distal sole portion (78), the first intermediate sole portion (80) and the second intermediate sole portion (82) can be integrally formed to provide a sole (20) that is a single and substantially continuous piece.

The first intermediate sole portion (80) is positioned adjacent and is connected to peripheral surface (20) at the edge (84). The second intermediate sole portion (82) is positioned adjacent to and is connected to the peripheral surface (20) at the edge (86). The proximate sole portion (76) curves upward towards and is connected to the intermediate sole portions (80) and (82). The proximate sole portion (76) is also connected to the lower edge (38) of face (16) at the curved comer (88). The distal sole portion (78) curves upward towards and is connected to the intermediate sole portions (80) and (82). The distal sole portion (78) is also connected to the peripheral surface (20) at the edge (90).

The center of gravity "CG" of the head (10) is positioned within the head (10) at a vertical distance CGz as measured from the lowest position (74) of the sole (20), a desired longitudinal distance CGy as measured from the heel point (26), and a desired lateral distance CGx as measured from lowest and outermost point (42) on the lower edge (38) of the face (16). Preferably, the center of gravity CG is positioned within the head (10) by varying the wall thickness (24) of the previously described portions of the head (10). The center of gravity CG can also be positioned within the head by simultaneously varying the wall thickness (24) of various portions of the head (10) optionally in combination with including additional elements into the head. In general, positioning the center of gravity closer to the sole (20) will produce a golf shot with a higher trajectory. Also, positioning the center of gravity further from the face (16) and heel (12) will assist the golfer in closing the face angle at the moment of impact, which will tend to produce shots which travel in a straight distance down the fairway.

An example of an additional element that may be used to adjust the location of the center of gravity is shown in FIG. 2. Specifically, a sole plate (92) is shown affixed to the sole (20). The sole plate (92) is connected to the head (10) using conventional means well known to those of ordinary skill in the art, and may be, for example embedded within the wall thickness of the sole (20) such that the exterior surface of sole plate (92) lies flush with the exterior surface of the sole (20). The sole plate (92) includes a shaft portion (94) and a pair of flukes (96) and (98) which flare out from a common end of the shaft (94) so that the sole plate (92) center of gravity "CGp" is offset in the direction of the point (72) from the center of gravity "CG" of the head (10) and away from the face (16). Preferably, the sole plate (92) comprises a material having a greater density than the remaining portions of the head (10) and has the effect of moving the position of the center of gravity "CG" of the head (10) toward the point (72) and toward the sole (20) when compared to a head (10) that does not include the sole plate (92). Those of ordinary skill in the art will recognize that the center of gravity "CG" of the head (10) can be located virtually anywhere within the head (10) by varying the wall thickness and including additional elements such as sole plate (92).

Having described the geometry and mass distribution of the inventive driver head in general terms, the specific values of certain parameters, which result in a driver head with increased performance and playability, will now be described. The driver of the present invention will exhibit improved performance and playability when it meets any one or more of the following conditions:

Condition (a) HL is greater than about 4.25" and less than about 4.50", BR is greater than about 4.15" and less than about 4.45", and HL minus BR is greater than about zero and less than about 0.25 inches Condition (b) (1) Condition (a) is satisfied; (2) CH is greater than about 1.85" and less than about 2.10"; and (3) FH is greater than about 1.75" and less than about 2.00";

Condition (c) (1) Conditions (a) or (b) are satisfied; (2) CGy is greater than about 1.65" and less than about 2.12"; (3) CGx is greater than about 1.15" and less than about 2.65"; and (4) CGz is greater than about 0.25" and less than about 0.85". The center of gravity will be furthest from the heel (12) when CGy is 2.12", will be furthest from the face (16) when CGx is 2.65", and closest to the sole (20) when CGz is 0.25".

Condition (d) (1) Conditions (a), (b), or (c) are satisfied; and (2) FL is greater than about 3.45" and less than about 4.00".

Condition (e) (1) Conditions (a), (b), (c) or (d) are satisfied; and (2) BP is greater than about 0.525" and less than about 0.625".

The progression of conditions described above is for that of a preferred embodiment of the driver head that is the subject of this invention. It is to be understood that the playability and performance of a driver can also be improved when any one or more of the conditions stated above are satisfied, though not necessarily presented in the same order.

The foregoing is a detailed description of preferred embodiments of the present invention. Those of ordinary skill in the art will recognize that modifications to the disclosed embodiments may be made without departing from the spirit and scope of the invention. In light of the present disclosure, those of ordinary skill in the art will also appreciate that many changes can be made to the specific embodiments which are disclosed herein and still obtain a like or similar result without departing from the spirit and scope of the invention. All of the embodiments disclosed and claimed herein can be made and executed without undue experimentation in light of the present disclosure.

What is claimed is:

1. A driver-type hollow-body golf club head comprising: a heel;

a surface located adjacent an upper portion of said heel and defining a circular bore for receiving one end of an elongated shaft, a centerline of said bore being spaced a radial distance (BP) from an outermost position on said heel;

a toe located substantially opposite said heel and spaced from said centerline of said bore;

a substantially planar face having a forwardmost position, a face length (FL) extending between said heel and said toe, and a face height (FH) substantially transverse to said face length;

wherein said substantially planar face lies along a first plane which intersects a second plane, which is coextensive with said centerline of said bore, at an acute left angle;

a crown having a proximate crown portion connected to said face, a distal crown portion opposite said proximate crown portion, a first intermediate crown portion and an opposing second intermediate crown portion, each of said first and second intermediate crown portions having an outermost part and being connected to each of said proximate and distal crown portions, said outermost parts of said first and second intermediate crown portions being spaced by a head length (HL), and said distal crown portion being positioned opposite said face and being spaced from said forwardmost position on said face by a head breadth (BR);

a sole opposite said crown, and having a lowest portion spaced from an uppermost position on said crown by a head height (CH), said sole having a proximate sole portion connected to said face, a distal sole portion opposite said proximate portion, a first intermediate sole portion and a second intermediate sole portion each said first and second intermediate sole portion being connected to each of said proximate and said distal sole portions; and a peripheral surface interposed said crown and said sole and connected to each of said distal and intermediate crown portions; each of said distal and intermediate sole portions and said face; wherein:

said club head length (HL) is greater than about 4.25 inches and less than about 4.50 inches;

said club head breadth (BR) is greater than about 4.15 inches and less than about 4.45 inches; and the difference (HL−BR) between said club head length (HL) and said club head breadth (BR) is less than about 0.25 inch and greater than about 0 inch.

2. A golf club head according to claim 1, wherein said radial distance (BP) is greater than about 0.525 inch and less than about 0.625 inch.

3. A golf club head according to claim 2, wherein:

said club head has a center of gravity spaced greater than about 0.25 inch and less than about 0.85 inch from said lowest portion of said sole, spaced greater than about 1.65 inch and less than about 2.12 inches from said outermost position on said heel, and spaced greater than about 1.15 inches and less than about 2.65 inches from an outermost position on said face.

4. A golf club head according to claim 3, wherein:

said club head height (CH) is greater than about 1.85 inches and less than about 2.10 inches; and said face height (FH) is greater than about 1.75 inches and less than about 2.00 inches.

5. A golf club head according to claim 4, wherein:

said face length (FL) is greater than about 3.45 inches and less than about 4.00 inches.

6. A golf club head according to claim 3, wherein:

said face length (FL) is greater than about 3.45 inches and less than about 4.00 inches.

7. A golf club head according to claim 2, wherein:

said club head height (CH) is greater than about 1.85 inches and less than about 2.10 inches; and said face height (FH) is greater than about 1.75 inches and less than about 2.00 inches.

8. A golf club head according to claim 7, wherein:

said face length (FL) is greater than about 3.45 inches and less than about 4.00 inches.

9. A golf club head according to claim 2, wherein:

said face length (FL) is greater than about 3.45 inches and less than about 4.00 inches.

10. A golf club head according to claim 1, wherein:

said club head has a center of gravity spaced greater than about 0.25 inch and less than about 0.85 inches from said lowest portion of said sole, spaced greater than about 1.65 inches and less than about 2.12 inches from said outermost position on said heel, and spaced greater than about 1.15 inches and less than about 2.65 inches from said forwardmost position of said face.

11. A golf club head according to claim 10, wherein: said club head height (CH) is greater than about 1.85 inches and less than about 2.10 inches; and said face height (FH) is greater than about 1.75 inches and less than about 2.00 inches.

12. A golf club head according to claim 11, wherein:

said face length (FL) is greater than about 3.45 inches and less than about 4.00 inches.

13. A golf club head according to claim 10, wherein:

said face length (FL) is greater than about 3.45 inches and less than about 4.00 inches.

14. A golf club head according to claim 1, wherein:

said club head height (CH) is greater than about 1.85 inches and less than about 2.10 inches; and said face height (FH) is greater than about 1.75 inches and less than about 2.00 inches.

15. A golf club head according to claim 14, wherein:

said face length (FL) is greater than about 3.45 inches and less than about 4.00 inches.

16. A golf club head according to claim 1, wherein:

said face length (FL) is greater than about 3.45 inches and less than about 4.00 inches.

17. An improved, hollow-bodied, drive-type golf club head comprising:

a crown having a crown toe area, a crown heel area, a crown front area, a crown rear area, and a hosel positioned in said crown heel area for securing a shaft;

a sole opposing said crown, having a substantially planar sole portion positioned coplanar with a plane defined by a lateral and longitudinal direction, and further having a sole toe area, a sole heel area, a sole front area and a sole rear area;

a substantially planar striking face extending between and connected to said crown front area and said sole front area, and having a substantially linear portion extending in a longitudinal direction;

a peripheral belt interposed said crown and sole, connected to opposing ends of said face, and extending between and connected to oppositely disposed said crown toe area and said sole toe area; said crown heel area and sole heel area; and said crown rear area and said sole rear area;

wherein the club head has a length measured by a longitudinal distance between a first outermost point on said crown toe area and a second outermost point on said crown heel area, the length being greater than about 4.25 inches and less than about 4.50 inches;

wherein, the club head has a breadth measured by the lateral distance between a forward most point on said face and an rearmost point on said crown rear area, the breadth being greater than about 4.15 inches and less than about 4.45 inches, and wherein the difference between the length and breadth is greater than about 0 inch and less than about 0.25 inch.

18. The improved, hollow-bodied driver type golf club head according to claim 17, wherein the club head has a height measured by the vertical distance between said sole planar portion and an uppermost point on said crown, the height being greater than about 1.85 inches and less than 2.10 inches, and wherein the club head has a face height measured by the vertical distance between said sole planar portion and a highest point on said face, the face height being greater than about 1.75 inches and less than about 2.00 inches.

19. An improved, hollow-bodied driver type golf club head according to claim 17, wherein the radial distance from a hosel centerline to said second outermost point on said crown heel area is greater than about 0.525 inch and less than about 0.625 inch.

20. An improved, hollow-bodied driver type golf club head according to claim 17 having a face length measured by the longitudinal distance between a face toe point and a face heel point, the face length being greater than about 3.45 inches and less than about 4.00 inches.

21. An improved driver type golf club head according to claim 17, wherein the club head's center of gravity is positioned:

a vertical distance of greater than about 0.85 inches and less than about 0.25 inches above said sole planar portion;

a longitudinal distance of greater than about 1.65 inches and less than 2.12 inches extending from said second outermost point on said crown heel area towards said crown toe area; and a lateral distance of greater than about 1.15 inches and less than about 2.65 inches extending from said forwardmost point on said face towards said toe.

* * * * *